US008979150B1

(12) United States Patent
McKissack

(10) Patent No.: US 8,979,150 B1
(45) Date of Patent: Mar. 17, 2015

(54) TUBING ELEVATOR LATCH

(71) Applicant: Gearench Division of Orbix Corporation, Clifton, TX (US)

(72) Inventor: Eric McKissack, Pearsall, TX (US)

(73) Assignee: Gearench, Clifton, TX (US)

( * ) Notice: Subject to any disclaimer, the term of this patent is extended or adjusted under 35 U.S.C. 154(b) by 19 days.

(21) Appl. No.: 14/010,372

(22) Filed: Aug. 26, 2013

Related U.S. Application Data

(60) Provisional application No. 61/695,783, filed on Aug. 31, 2012.

(51) Int. Cl.
*B66C 1/00* (2006.01)
*E21B 19/06* (2006.01)
*E21B 19/07* (2006.01)

(52) U.S. Cl.
CPC ..... *E21B 19/07* (2013.01)
USPC ..... 294/90; 294/102.2; 166/77.52; 175/423

(58) Field of Classification Search
USPC ..... 294/90, 102.2, 106, 113, 116, 902, 294/102.1, 119.2, 31.2; 166/77.1, 75.14, 166/77.14, 77.51–77.52, 85.1, 86.1; 81/57.15, 57.16, 57.33, 57.34; 175/423
See application file for complete search history.

(56) References Cited

U.S. PATENT DOCUMENTS

| | | | |
|---|---|---|---|
| 2,067,663 | A | 1/1937 | Grau |
| 2,264,775 | A | 12/1941 | Spang |
| 3,063,509 | A | 11/1962 | Guier |
| 3,140,523 | A | 7/1964 | Taylor, Jr. |
| 3,309,130 | A | 3/1967 | Arrowood |
| 3,458,230 | A | 7/1969 | Jones et al. |
| 3,884,519 | A | 5/1975 | McFadden |
| 4,511,169 | A | 4/1985 | Willis |
| 5,340,182 | A | 8/1994 | Busink et al. |
| 6,227,587 | B1 | 5/2001 | Terral |
| 2010/0200221 | A1 | 8/2010 | Sipos |

FOREIGN PATENT DOCUMENTS

| | | | |
|---|---|---|---|
| CN | 2918715 | Y | 7/2007 |
| GB | 403367 | | 12/1933 |
| GB | 426206 | | 3/1935 |
| GB | 439396 | | 12/1935 |
| GB | 468085 | | 6/1937 |
| GB | 469326 | | 7/1937 |
| GB | 469327 | | 7/1937 |
| GB | 484025 | | 4/1938 |
| GB | 491816 | | 9/1938 |
| GB | 862411 | | 3/1961 |
| RU | 2214498 | C2 | 10/2003 |
| RU | 2194840 | C2 | 12/2012 |
| WO | 2011060773 | A2 | 5/2011 |

*Primary Examiner* — Stephen Vu
(74) *Attorney, Agent, or Firm* — Bracewell & Giuliani LLP

(57) ABSTRACT

An elevator for raising and lowering a string in a wellbore includes left and right bodies hinged together that selectively open and close. The elevator can be a tubing elevator, and the string can be a tubing string, casing, or drill string. Semi-circular channels on an inner surface of each of the bodies face one another when the bodies are in the closed position and define a circular collar for engaging the string. A retainer on one of the bodies selectively pivots into latching engagement with a lug on the other body to hold the bodies in the closed position. A boss projects radially inward from an inner surface of the retainer and a retainer pin selectively is moveable adjacent the boss to lock the retainer in its latching engagement with the lug. The pin moves to adjacent the boss when the elevator contacts a collar.

13 Claims, 5 Drawing Sheets

TUBING ELEVATOR LATCH

CROSS REFERENCE TO RELATED APPLICATIONS

This application claims priority to and the benefit of U.S. Provisional Application Ser. No. 61/695,783, filed Aug. 31, 2012, the full disclosure of which is hereby incorporated by reference herein for all purposes.

BACKGROUND

1. Field of Invention

The present disclosure relates in general to an elevator for an oilfield tubular. More specifically, the present disclosure relates to an elevator having a locking system for maintaining engagement of the elevator with a tubular when the elevator encounters a collar on the tubular.

2. Description of Prior Art

Tubing elevators typically include left and right bodies that couple together on one end with a barrel type hinge. A semi-circular recess is generally provided axially along an inner surface of each of the bodies. Closing the elevator brings the bodies together so their respective recesses face one another and engage opposing sides of a tubing string. Generally, a retainer and lug are provided for latching together the left and right bodies when in the closed position. Typically, the lug projects outward from a front surface of the right body and the retainer pivotingly attaches to a front surface of the left body; the retainer is positioned so that it can selectively swing into latching engagement with the lug. When the retainer swings into the latching position, the lug inserts into an opening formed through the retainer.

Tubing elevators usually are equipped with tie bars that mount on lateral sides of the left and right bodies. The tie bars are engaged by elevator links provided on a traveling block for raising and lowering the tubing elevator; where drilling rig drawworks are typically included for controlling movement of the traveling block. The left and right bodies are kept in the closed position as long as the retainer is adjacent the front surface of the right body and the lug is inserted into the retainer opening.

SUMMARY OF THE INVENTION

Disclosed herein is an example of an elevator for use with a tubular string. In an example the elevator includes a main body that selectively moves between an open configuration and a closed configuration. The main body has an axial opening that selectively circumscribes the tubular string when the main body is in the closed configuration. A lug projects outward from the main body. Also included is a retainer with an end pivotingly coupled on a lateral surface of the main body. The retainer is moveable into a latching configuration with the lug so that the main body is held in the closed configuration. Also included with the main body is a retainer stop that can be moved into selective locking engagement with the retainer, so that the retainer remains in the latching configuration with the lug when in locking engagement with the retainer stop. In an alternative, the main body is made up of a left body hinged to a right body, and wherein a semi-circular channel on an inner surface of the left body faces a semi-circular channel on an inner surface of the right body when the main body is in the closed configuration to define the axial opening. The elevator can optionally further include a boss that projects radially inward from an inner surface of the retainer towards the tubular string, so that when the retainer stop is in locking engagement with the retainer, the retainer stop is in a path the boss follows when the retainer is pivoted away from the main body. In an example, the retainer stop has a planar upper section and a cylindrical shaped lower section, wherein the lower section inserts into an axial bore in the main body, and wherein when the upper section contacts a collar on the tubing string, the retainer stop is urged axially into the main body so that the lower section is moved into locking engagement with the retainer. In this example, the elevator has a spring for biasing the retainer stop upward, so that when the elevator is moved away from the collar, the retainer stop is urged out of locking engagement with the retainer. In an alternate embodiment, the elevator also has a profile on a lateral side of the retainer stop and a key coupled to the main body for maintaining an azimuthal orientation of the retainer stop. In an example embodiment, the elevator is a tubing elevator and the tubular string is a tubing string.

Another example of an elevator for use with a tubular string in a wellbore is made up of a left body, a right body hingedly coupled with the left body, semi-circular channels formed on respective surfaces of the left and right bodies, so that when the left and right bodies are put into a closed configuration, the channels face one another to define an axial opening. This example further includes a lug engageable by a retainer for retaining the left and right bodies in the closed configuration, and a retainer stop for selectively locking the retainer in engagement with the lug when the tubing elevator is proximate a collar on the tubing string. In an optional embodiment, the elevator includes a boss that projects outward from the retainer, and wherein the retainer stop moves axially to a locking position into interference with the boss for keeping the retainer in engagement with the lug. Optionally, an upper end of the retainer stop contacts a lower surface of the collar to move the retainer stop downward to lock the retainer in engagement with the lug. The elevator can also have a spring for biasing the retainer stop upward and out of locking engagement with the retainer when the elevator is moved away from the collar, a profile on a lateral side of the retainer stop, and a key coupled to the main body for maintaining an azimuthal orientation of the retainer stop. In an alternative example, an upper surface of at least one of the left body and right body slopes axially downward adjacent the axial opening. In an example embodiment, the retainer is made of a generally planar member having upper and lower lateral members joined at one end by a vertical member to define an open space bounded by the lateral and vertical members, and hinge couplings on ends of the lateral members distal from the vertical member that couple with the left body. In this example of the elevator, the retainer is engaged by the lug by pivoting the retainer about the hinge couplings so the vertical member is on a side of the lug opposite the hinge couplings and wherein the lug inserts into the open space. The elevator can further include a spring for biasing the retainer so the vertical member is adjacent the right body. A planar lock member may optionally be included that is hingedly mounted to the retainer adjacent where the retainer engages the lug, and a spring for biasing the lock. In an example, the elevator is a tubing elevator, and the tubular string is a tubing string.

BRIEF DESCRIPTION OF DRAWINGS

Some of the features and benefits of the present invention having been stated, others will become apparent as the description proceeds when taken in conjunction with the accompanying drawings, in which.

Figure 1:
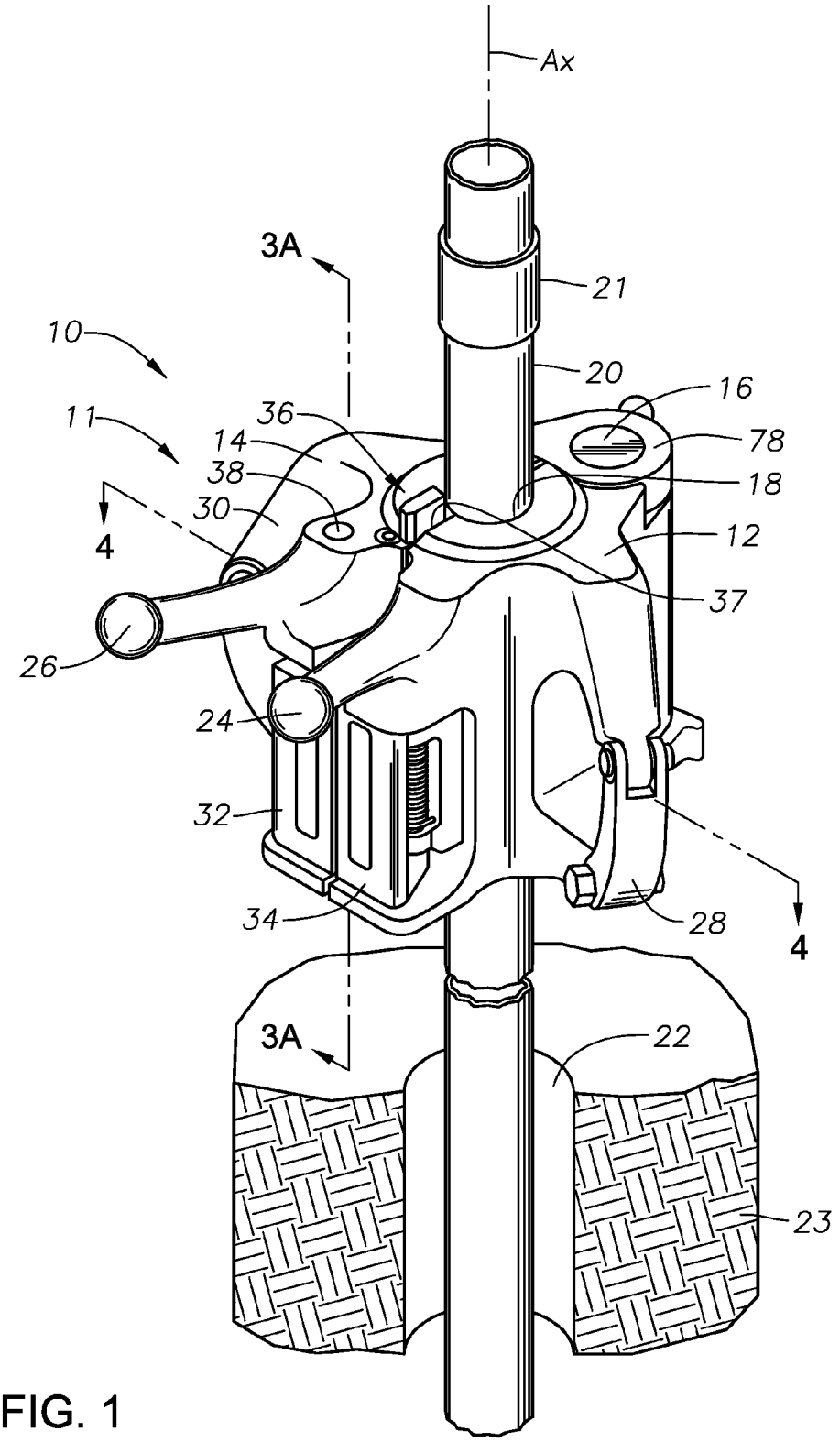
FIG. 1 is a side perspective view of an example embodiment of a tubing elevator on a tubing string in accordance with the present invention.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF AN EMBODIMENT

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

FIG. 1 illustrates a side perspective view of one example of a elevator 10 shown having a main body 11 made up of a right body 12 and left body 14. The right and left bodies 12, 14 are shown in a closed configuration and hingedly coupled to one another by a hinge pin 16 inserted into an end of each of the bodies 12, 14. Each of the bodies 12, 14 have a semicircular channel formed through an inner surface so that when the bodies 12, 14 are put into the closed configuration, the channels face one another to define a generally circular opening 18 that extends axially through the main body 11. A string of tubing 20 is shown inserted through the opening 18, where individual segments of the string 20 are connected by a collar 21 shown set spaced above an upper surface of the main body 11. The collar 21 has an outer diameter that extends radially past an outer diameter of the segments of tubing 20 to define a raised shoulder that faces an upper surface of the main body 11. Although in the example of FIG. 1 the elevator 10 handles tubing 20, included in the present disclosure are embodiments of the elevator 10 that handle any tubular string, such as casing, a drill string, conductor pipe, and the like.

Below the elevator 10, the tubing 20 projects downward into a borehole 22 that is formed in a subterranean formation 23. Handles 24, 26 are shown on forward-facing surfaces of the right and left bodies 12, 14 and are elongated members that project radially outward from the main body 11. The handles 24, 26 may be used for opening and closing the main body 11 so the elevator 10 may selectively engage and disengage the tubing string 20. Each of the right and left bodies 12, 14 include a tie bar 28, 30 that provides a point on the main body 11 for attaching a link to a travelling block (not shown) for raising and lowering the elevator 10 on a drilling rig (not shown).

A retainer 32 is shown provided on a forward-facing surface of the main body 11 and, as will be described in more detail below, is for keeping the right and left bodies 12, 14 in the closed configuration shown in FIG. 1. Adjacent the retainer 32 on the forward-facing surface of the main body 11 is a lock 34 used for disengaging the retainer 32 so the bodies 12, 14 may be pivoted with respect to one another to put the main body 11 into an open configuration. Further provided in the example of FIG. 1 is a retainer stop 36 shown projecting axially upward from an upper surface of the main body 11 and adjacent the opening 18. The retainer stop 36 is axially moveable within a recess 37 that projects into the left body 14 downward from the upper surface of the main body 11 and along an outer radius of the opening 18. Also on the left body 14 is a hinge pin 38 that axially depends into a bore and is for hingedly mounting the retainer 32 to the left body 14.

Figure 2:
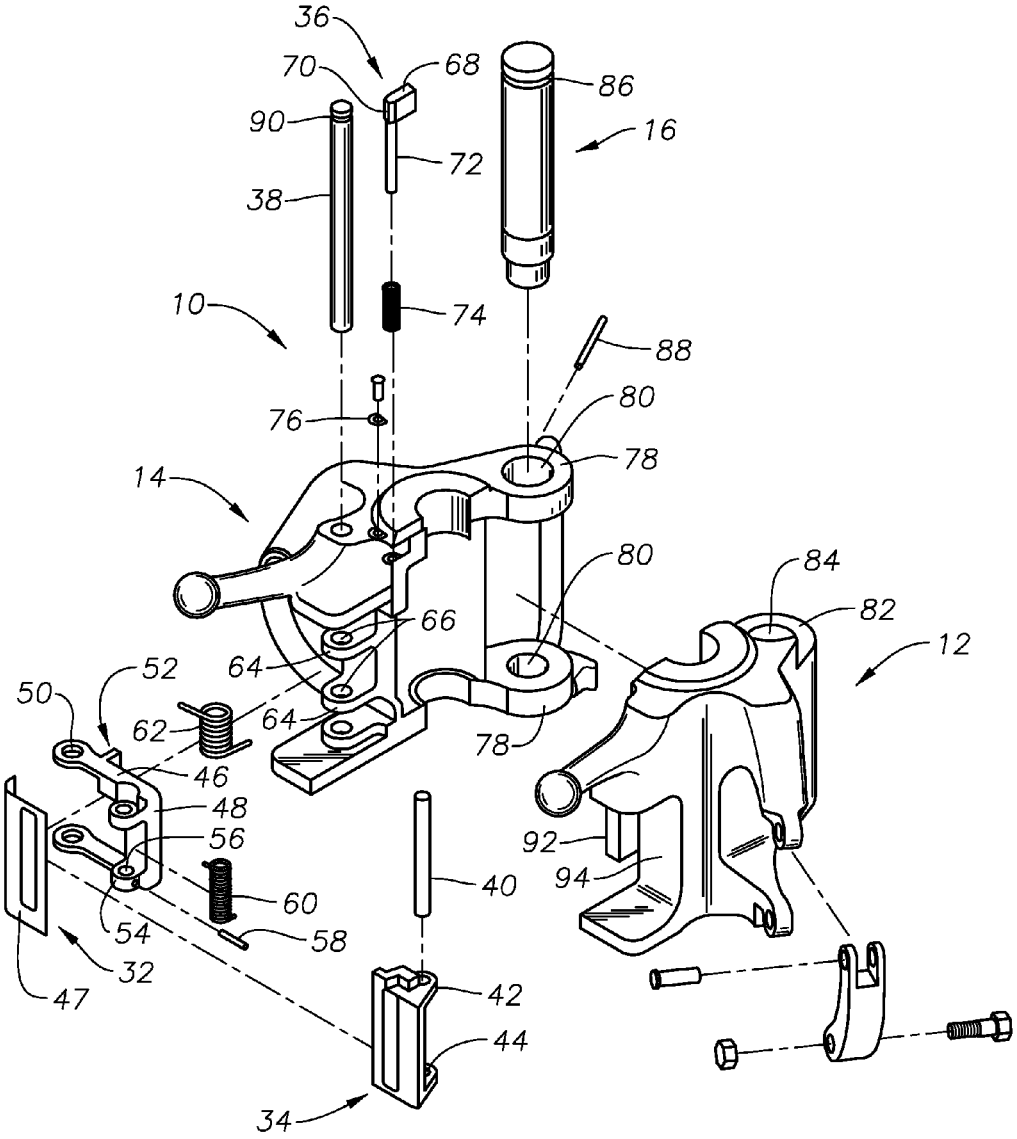
FIG. 2 is an exploded view of an embodiment of the tubing elevator of FIG. 1 in accordance with the present invention.

An example embodiment of the elevator 10 is shown in an exploded view in FIG. 2. In this example a hinge pin 40 is shown set above the lock 34, and when the elevator 10 is assembled, the hinge pin 40 inserts into tabs 42 that project radially inward from upper and lower ends of the lock 34. Bores 44 are formed axially through the tabs 42 and are sized to receive and retain the hinge pin 40 therein. Further detail of the retainer 32 is provided in FIG. 2 illustrating the retainer 32 includes a pair of lateral members 46 that define upper and lower portions of the retainer 32. A cover plate 47 optionally mounts onto the retainer 32 and on a side opposite where the retainer 32 couples to the main body 11. The lateral members 46 of FIG. 2 are generally elongate and shown spaced vertically apart and connected to one another by an end member 48 that vertically extends between terminal ends of the lateral members 46. Ends of the lateral members 46 distal from the end member 48 are provided with axial bores 50 and sized to receive hinge pin 38 therein so that the retainer 32 can rotate with respect to the left body 12 and about hinge pin 38.

At least one of the lateral members 46 is provided with a boss 52, which in the example of FIG. 2 is an elongate planar shaped element that projects radially inward from the surface of the retainer 32 that faces the left member 14. Axially spaced apart cylinders 54 are further illustrated disposed on a side of the retainer 32 opposite the boss 52 and on the end member 48. The cylinders 54 are provided with axial bores 56 that receive hinge pin 40, so that the lock 34 can rotate with respect to the retainer 32 and about hinge pin 40. An optional pin 58 is shown insertable into an aperture shown formed through a sidewall of the lower of the cylinders 54 for engagement with a lower end of the hinge pin 40 so the hinge pin 40 is retained within cylinder 54. A spring 60 is illustrated for circumscribing hinge pin 40 when assembled, which provides a biasing force onto the lock 34 to retain the lock 34 in a designated orientation. An additional spring 62 is shown for insertion between bores 50 and for receiving hinge pin 38 therein. The spring 62 biases the retainer 32 so that the end member 48 is set adjacent a forward-facing surface of the right body 12. Additional cylinders 64 are shown mounted on the forward face of the left body 14 that are fitted with corresponding bores 66; registering the bores 50 with bores 66, and inserting hinge pin 38 through the registered bores 50, 66 the retainer 32 may be hingedly mounted onto the left body 14.

Still referring to FIG. 2, the retainer stop 36 is shown having an upper portion 68 which is a generally planer member with elongate sides that extend generally parallel to the axis $A_x$ (FIG. 1) of the elevator 10 and along the line radial to the axis $A_x$. A profile 70 is shown formed along an elongate edge of an outer side of the upper portion 68. A substantially cylindrical pin 72 depends axially downward from an end of the upper portion 68 and adjacent the profile 70. A spring 74 shown adjacent a lower end of the pin 72 circumscribes the pin 72 when the elevator 10 is assembled. As will be described in more detail below, the spring 74 provides an upwardly biasing force onto the retainer stop 36. To maintain the retainer stop 36 in the azimuthal orientation of FIG. 2, an optional stop key 76 is shown set within a recess on an upper portion of the left body 14. In the example of FIG. 2, the stop key 76 is a washer-like member and having a portion of the outer periphery removed to define a lateral straight edge.

Cylinders 78 are shown set on an inner surface of the left body 14 at upper and lower ends of the body 14. Axial bores 80 extend through the cylinders 78. A corresponding barrel cylinder 82 is shown provided on a rearward end of the right body 12 and includes an axial bore 84 therethrough. When assembled, the barrel cylinder 82 sets between the cylinders 78 with the respective bores 80, 84 registered, so that hinge pin 86 may be inserted through the bores 80, 84 to thereby hingedly couple together the right and left bodies 12, 14. An optional groove 86 is shown circumscribing an outer surface of hinge pin 16 engageable by a pin 88 that projects through a lateral aperture through cylinder 78 for retaining pin 16 within the left body 14. Similarly, groove 90 circumscribes hinge pin 38 for engagement by a retaining pin (not shown) to keep the hinge pin 38 in place within the left body 14.

A lug 92 is illustrated projecting radially outward from a forward surface 94 on the right body 12. The retainer 32 is configured so that when pivoted over the forward surface 94, the end member 48 extends past the lug 92 and on a side distal from the bores 50 on the lateral members 46. When the retainer 32 is pivoted so the lateral members 46 run along the front faces of the right and left bodies 12, 14, the end member 48 interferes with movement of the lug 92 in a direction away from the left body 14. Thus, the retainer 32 prevents the right and left bodies 12, 14 from pivoting outward from one another thereby retaining the main body 11 in a closed position and in close cooperation with outer surface of the tubing 20.

Figure 3A:
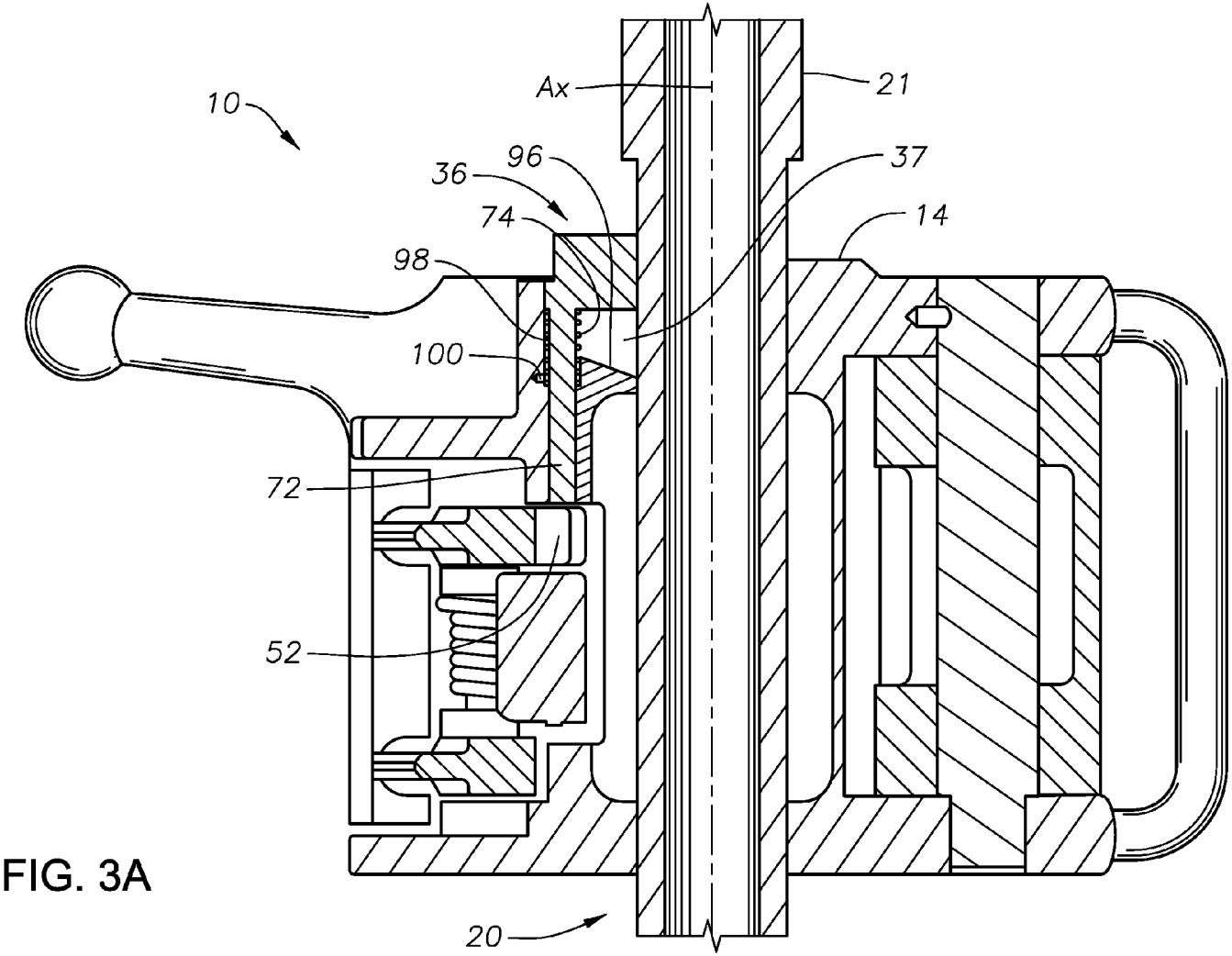
FIG. 3A is a side sectional view of an embodiment of the tubing elevator and tubing string of FIG. 1 taken along lines 3A-3A and in accordance with the present invention.
Figure 3B:
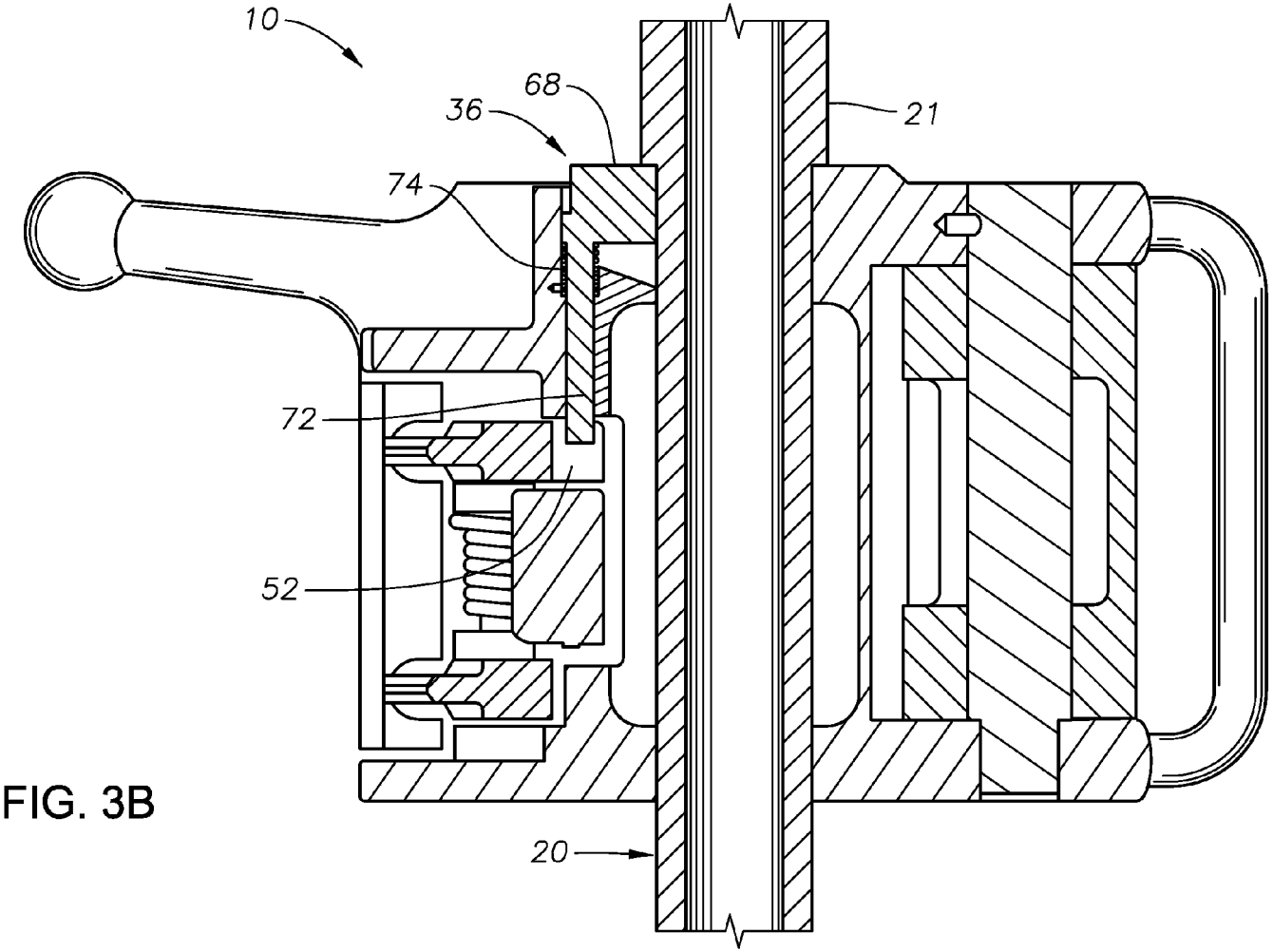
FIG. 3B is a side sectional view of an embodiment of the tubing elevator and tubing string of FIG. 3A, where the tubing elevator is in contact with a collar on the tubing string and in accordance with the present invention.

FIGS. 3A and 3B respectively illustrate side sectional views of the elevator 10 spaced downward from a lower surface of collar 21, and moved upward and into engagement with the lower surface of collar 21. As illustrated in the example of FIG. 3A, which is taken along lines 3A-3A, the spring 74 is set in a slot 98 formed axially through the left body 14 for upwardly biasing the retainer stop 36 from within the slot 98. Further illustrated in this example is that a lower surface 96 of the recess 37 slopes downward with distance towards the opening 18, thereby providing for ease of removal of dirt, grease, and other debris from within the opening 18. A port 100 is shown provided on a forward-facing surface of the left body 14 for providing lubricant into the slot 98. Referring now to FIG. 3B, the elevator 10 has been moved upward, such as by activating the drawworks and travelling block, so that an upper surface of the elevator contacts a lower surface of the collar 21. With continued upward movement of the elevator 10, the collar 21 contacts the upper portion 68 of the retainer stop 36 thereby downwardly urging the pin 72 to a position adjacent the boss 52 while depressing the spring 78. In this example, the pin 72 is moved to adjacent the boss 52 to a position that interferes with a path the boss 52 would travel when disengaging the retainer 32 from lug 92. As such, when the retainer stop 36 is depressed downward, the retainer 32 is locked into engagement with the lug 92; which as explained above prevents rotating the left and right bodies 12, 14 so that the main body 11 is kept in a closed position around tubing 20. By locking the retainer 32 as described, the elevator 10 will continue to grapple and hold the tubing 20 for retaining the tubing 20 at a desired elevation.

Figure 4:
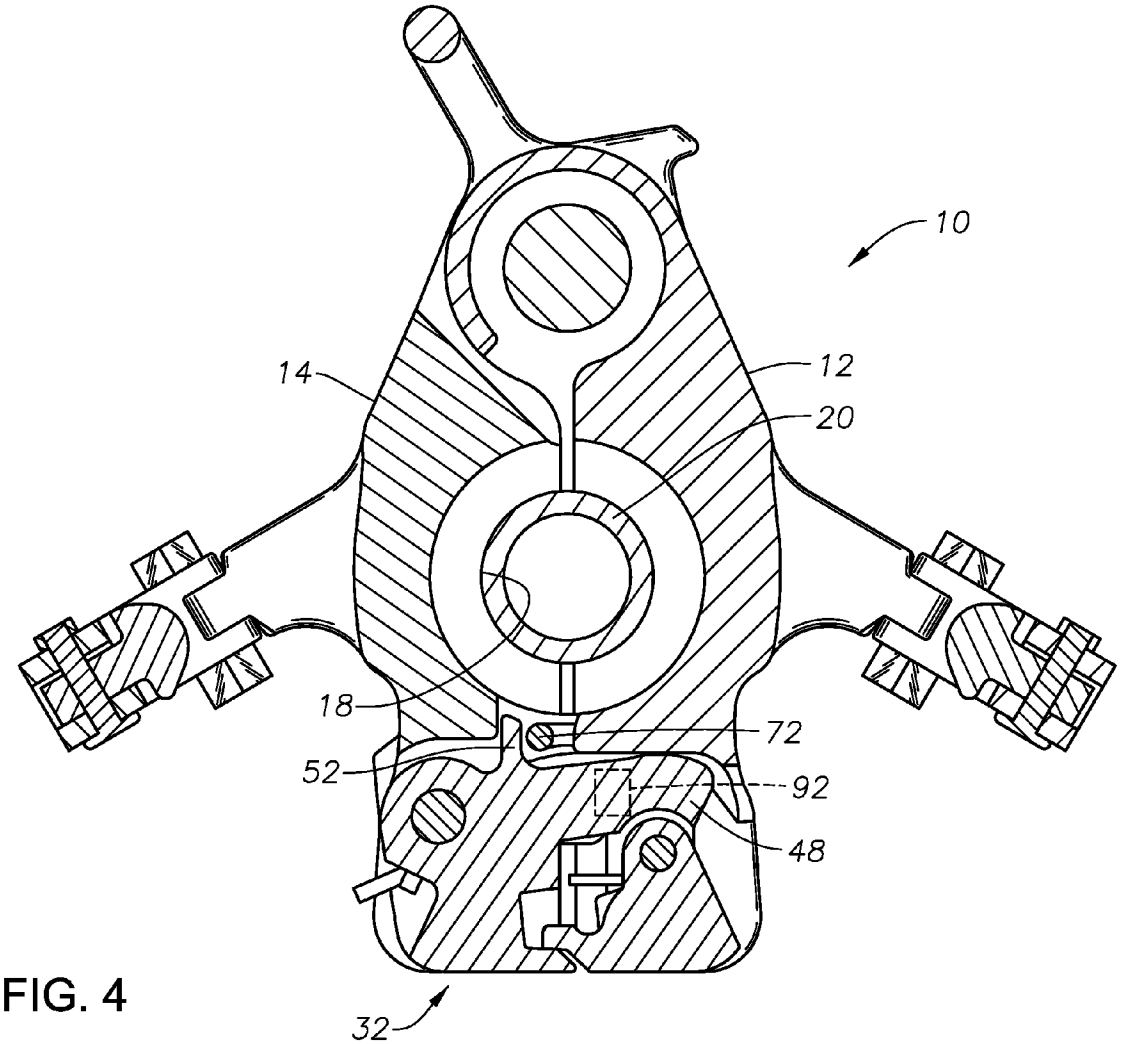
FIG. 4 is a plan sectional view of an embodiment of the tubing elevator of FIG. 1 taken along lines 4-4 and in accordance with the present invention.

FIG. 4 is a plan sectional view of the example elevator 10 of FIG. 1 and taken along lines 4-4. In the example of FIG. 4, the retainer stop 36 is shown in the locking position so that the pin 72 is urged downward and adjacent the boss 52. Thus, in this example, the presence of the pin 72 interferes with prospective motion of the boss 52 thereby maintaining the retainer 32 in engagement with the lug 92 (shown in dashed outline). Further shown in the example of FIG. 4 is the tubing held within the elevator 10 and inside the opening 18.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. An elevator for use with a tubular string comprising:

a main body that is selectively moveable between an open configuration and a closed configuration;

an axial opening in the main body that selectively circumscribes the tubing when the main body is in the closed configuration;

a lug that projects outward from the main body;

a retainer having an end pivotingly coupled on a lateral surface of the main body that is moveable into a latching configuration with the lug so that the main body is held in the closed configuration;

a retainer stop in the main body moveable into selective locking engagement with the retainer so that the retainer remains in the latching configuration with the lug when in locking engagement with the retainer stop;

a boss that projects radially inward from an inner surface of the retainer towards the tubular string, so that when the retainer stop is in locking engagement with the retainer, the retainer stop is in a path followed by the boss when the retainer is pivoted away from the main body; and wherein the retainer stop comprises a planar upper section and a cylindrical shaped lower section, wherein the lower section inserts into an axial bore in the main body, and wherein when the upper section contacts a collar on the tubular string, the retainer stop is urged axially into the main body so that the lower section is moved into locking engagement with the retainer.

2. The elevator of claim 1, wherein the main body comprises a left body hinged to a right body, and wherein a semi-circular channel on an inner surface of the left body faces a semi-circular channel on an inner surface of the right body when the main body is in the closed configuration to define the axial opening.

3. The elevator of claim 1, further comprising a spring for biasing the retainer stop upward, so that when the elevator is moved away from the collar, the retainer stop is urged out of locking engagement with the retainer.

4. The elevator of claim 1, further comprising a profile on a lateral side of the retainer stop and a key coupled to the main body for maintaining an azimuthal orientation of the retainer stop.

5. The elevator of claim 1, wherein the tubular string comprises a tubing string.

6. The elevator of claim 5, wherein an upper end of the retainer stop contacts a lower surface of the collar to move the retainer stop downward to lock the retainer in engagement with the lug.

7. The elevator of claim 5, further comprising a spring for biasing the retainer stop upward and out of locking engagement with the retainer when the elevator is moved away from the collar, a profile on a lateral side of the retainer stop, and a key coupled to the main body for maintaining an azimuthal orientation of the retainer stop.

8. The elevator of claim 5, wherein an upper surface of at least one of the left body and right body slopes axially downward adjacent the axial opening.

9. The elevator of claim 8, wherein the retainer is engaged by the lug by pivoting the retainer about the hinge couplings so the vertical member is on a side of the lug opposite the hinge couplings and wherein the lug inserts into the open space.

10. The elevator of claim 5, further comprising a planar lock member hingedly mounted to the retainer adjacent where the retainer engages the lug, and a spring for biasing the lock.

11. The elevator of claim 5, wherein the tubular string comprises a tubular selected from the group consisting of a tubing string, a drill string, and casing.

12. An elevator for use with a string in a wellbore comprising:

a left body;

a right body hingedly coupled with the left body;

semi-circular channels formed on respective surfaces of the left and right bodies, so that when the left and right bodies are put into a closed configuration, the channels face one another to define an axial opening;

a lug engageable by a retainer for retaining the left and right bodies in the closed configuration;

a retainer stop for selectively locking the retainer in engagement with the lug when the elevator is proximate a collar on the string;

a boss that projects outward from the retainer, and wherein the retainer stop moves axially to a locking position into interference with the boss for keeping the retainer in engagement with the lug; and wherein the retainer comprises a generally planar member having upper and lower lateral members joined at one end by a vertical member to define an open space bounded by the lateral and vertical members, and hinge couplings on ends of the lateral members distal from the vertical member that couple with the left body.

13. The elevator of claim 12, further comprising a spring for biasing the retainer so the vertical member is adjacent the right body.

* * * * *